United States Patent [19]

Kozuka et al.

[11] Patent Number: 4,843,986

[45] Date of Patent: Jul. 4, 1989

[54] THREAD FEEDING APPARATUS FOR MULTI-NEEDLE SEWING MACHINE

[75] Inventors: Tadashi Kozuka, Komae; Minoru Ozaku, Nishitama; Yuji Yamamoto, Chofu; Yoichi Ando, Tokyo, all of Japan

[73] Assignee: Juki Corporation, Tokyo, Japan

[21] Appl. No.: 187,386

[22] Filed: Apr. 28, 1988

[30] Foreign Application Priority Data

Apr. 28, 1987 [JP] Japan ..... 62-105360

[51] Int. Cl.[4] ..... D05B 1/08; D05B 45/00

[52] U.S. Cl. ..... 112/163; 112/302; 112/121.11

[58] Field of Search ..... 112/163, 167, 302, 308, 112/309, 121.11, 121.12

[56] References Cited

U.S. PATENT DOCUMENTS

| | | | |
|---|---|---|---|
| 3,609,373 | 9/1971 | Desai et al. | 112/121.11 X |
| 4,664,048 | 5/1987 | Naganuma et al. | 112/153 X |
| 4,766,827 | 8/1988 | Matsubara | 112/302 X |
| 4,784,071 | 11/1988 | Sadeh et al. | 112/121.12 |

*Primary Examiner*—Peter Nerbun

*Attorney, Agent, or Firm*—Morgan & Finnegan

[57] ABSTRACT

When two stitch lines parallel with the hem of a workpiece are stitched by a multi-needle sewing machine, a thread feeding apparatus positively feeds threads to each needle in proportion to the radius of the stitch line curvature such that well-balanced stitch lines are performed. Sensors located adjacent to said needles, and CPU (Central Processing Unit) operate cooperatively to drive each stepping motor which positively feeds the exactly required stitch length to each needle.

8 Claims, 6 Drawing Sheets

THREAD FEEDING APPARATUS FOR MULTI-NEEDLE SEWING MACHINE

BACKGROUND OF THE INVENTION

This invention relates to a multi-needle sewing machine and, more particularly, this invention enables a multi-needle sewing machine to sew parallel curved stitch lines by controlling the feeding of each needle thread in proportion to each radius of curvature of the stitch line.

Generally, a take-up lever is used for controlling the supply of a needle thread. In some cases, extra thread feeding controllers are equipped such that the needle thread is fed positively from a thread spool.

Referring to FIG. 5, where two stitch lines 2, 3 are to be positioned with a predetermined margin from the end of the workpiece, if the thread feeding rates for both stitch lines 2, 3 are adjusted for the stitch line 2, the stitch line 3 tends to be stitched in a looser condition than the stitch line 2 because the radius $r_2$ is smaller than the radius $r_1$.

On the other hand, if the thread feeding rates for both stitch lines 2, 3 are adjusted for the stitch line 3, the stitch line 2 tends to be stitched in a tensioned condition and the workpiece shrinks at the periphery. Thus, it is very difficult to make well-balanced and technically fine stitch lines.

SUMMARY OF THE INVENTION

With the foregoing in mind, it is therefore an object of this invention to provide an improved thread feeding apparatus for multi-needle sewing machines.

In a multi-needle sewing machine wherein multiple needles are installed at a needle bar and each needle thread is fed automatically by an individual thread feeder, sensing elements which detect the radius of curvature of a workpiece operate the radius of each stitch line and the thread feed rate per each stitch. Thus, the thread feeding apparatus is arranged to feed at the thread feeding rate. The margin, the distance between the needles, the stitch pitch, and the radius of curvature of workpiece are input to operate the thread feeding apparatus.

According to the invention, the radius of curvature is operated by the sensor and the stitch length per each stitch line is operated referring to this radius of curvature. Each thread feeding device controls each individual stitch pitch such that each stitched line is well stitch without causing shrinking on the surface of workpiece.

BRIEF DESCRIPTION OF THE DRAWINGS

The accompanying drawings, referred to herein and constituting a part hereof, illustrate preferred embodiments of the invention and, together with the description, serve to explain the principles of the invention, wherein.

DETAILED DESCRIPTION OF THE DRAWINGS

Figure 1:
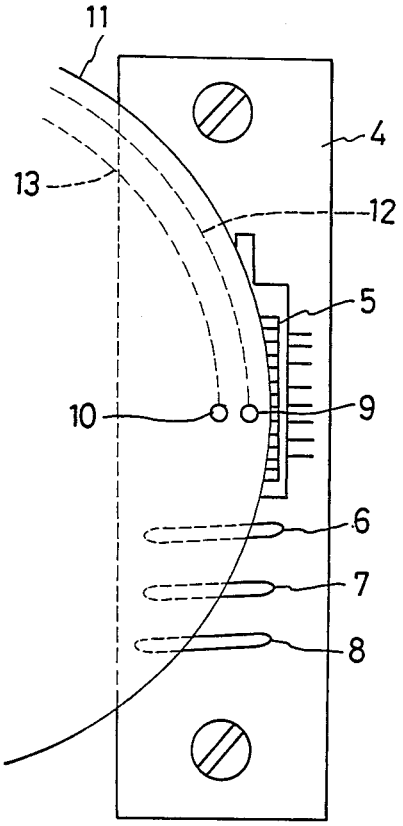
FIG. 1 is a plan view of a throat plate according to this invention.

Referring to FIG. 1, which illustrates plan view of a throat plate 4, a feed dog 5 is provided at the throat plate 4, and a first sensor 6, a second sensor 7, and a third sensor 8 are provided adjacent to the feed dog 5. These sensors 6, 7, 8 comprise photo-diodes or photo-transistors to constitute a photo-detector, and a so-called photo-isolator (or photo-coupler) are used. In this embodiment, a first needle 9 and a second needle 10 are provided, and a workpiece 11 is arcuate shaped. An outer stitch line 12 and a inner stitch line 13 are stitched a shown.

Figure 2:
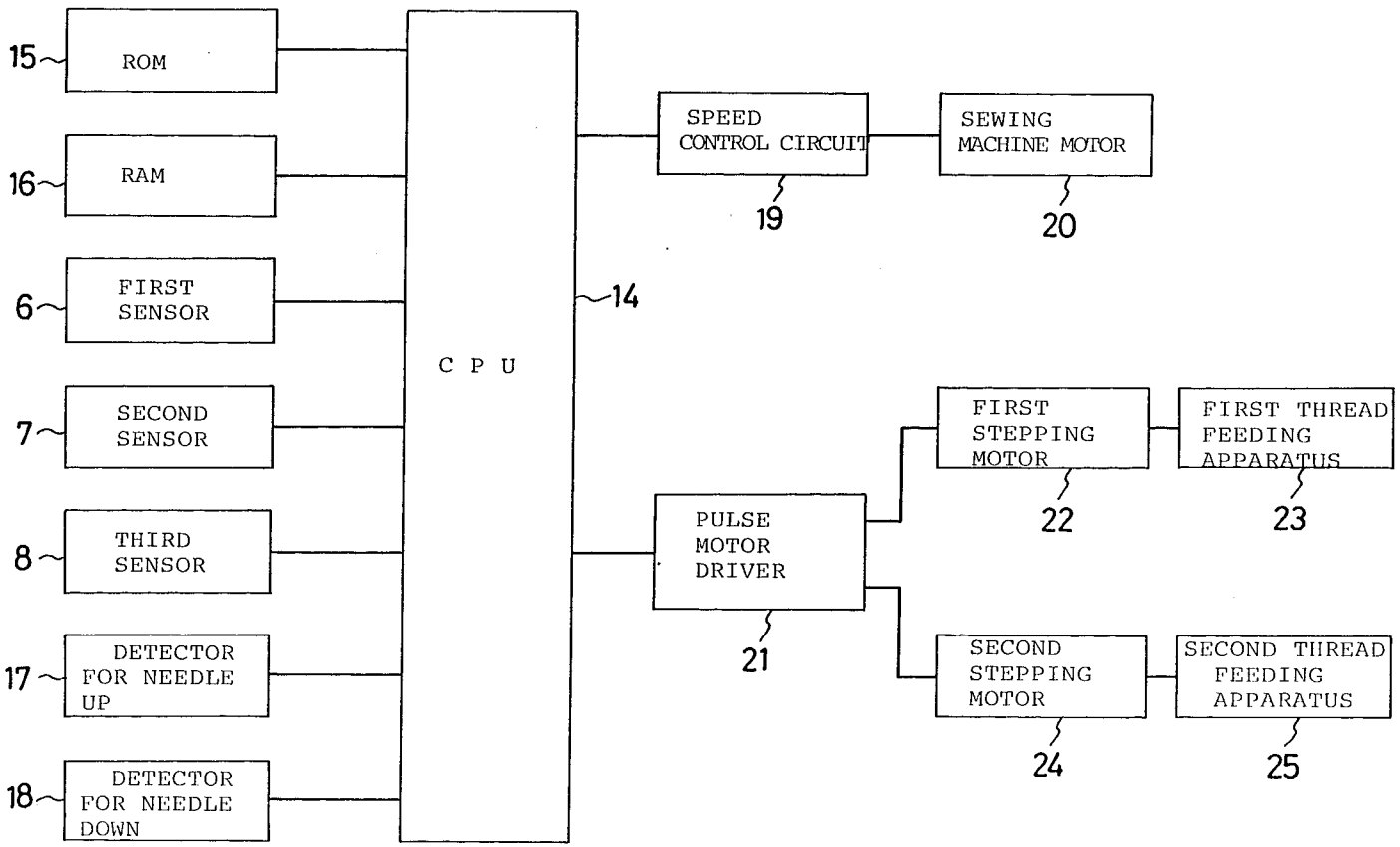
FIG. 2 is a block diagram according to one embodiment of this invention.

Referring to FIG. 2, which illustrates a block diagram according to this invention, the input side of a CPU (Central Processing Unit) 14 is connected to the first sensor 6, the second sensor 7, the third sensor 8, a ROM (Read Only Memory) 15, a RAM (Random Access Memory), a detector for detecting the needle down position 17, and a detector for detecting the needle up position 18.

The output side of the CPU 14 is connected to a speed control circuit 19 and then to a sewing machine motor 20, a pulse motor driver 21 and then branched to a first stepping motor 22 and to a first thread feeding apparatus 23 in series, and branched also to a second stepping motor 24 and then to a second thread feeding apparatus 25 in series as shown in FIG. 2.

Figure 3A:
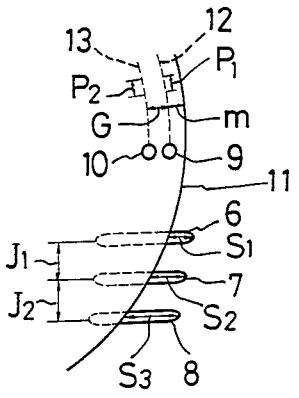
FIG. 3A, FIG. 3B, FIG. 3C are illustrative drawings supplementing FIG. 1 and FIG. 2.
Figure 3B:
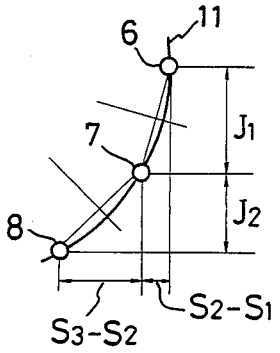
Figure 3C:
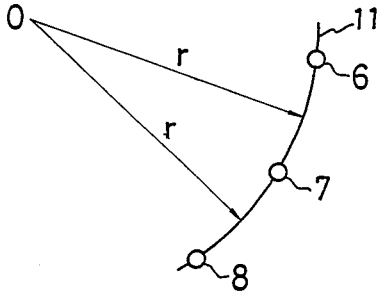
Figure 3D:
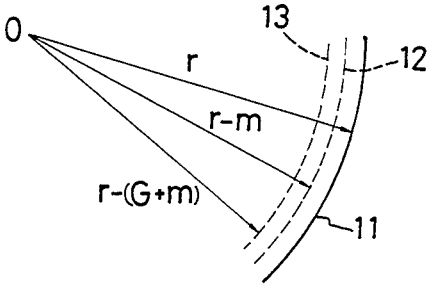
Figure 4:
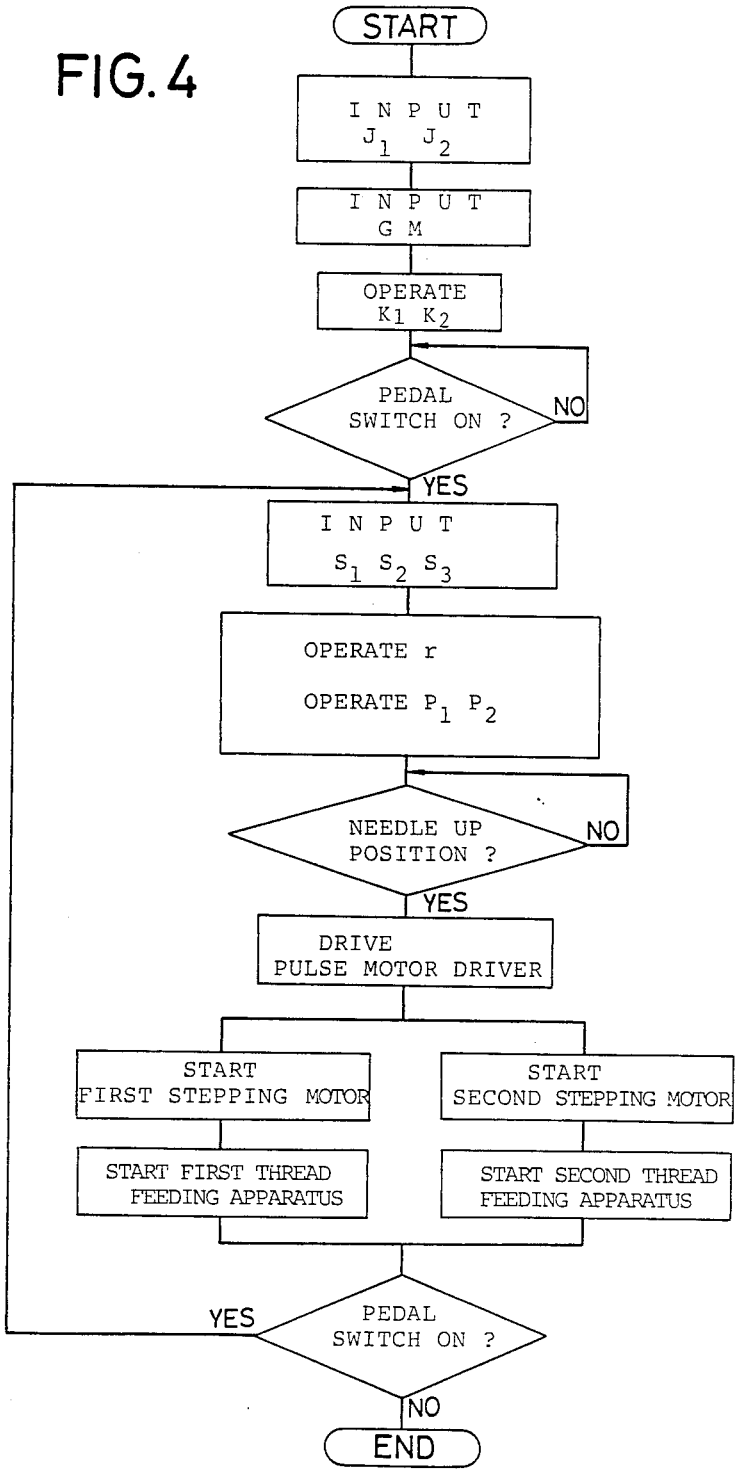
FIG. 4 is a flow chart illustrating FIG. 1 and FIG. 2.
Figure 5:
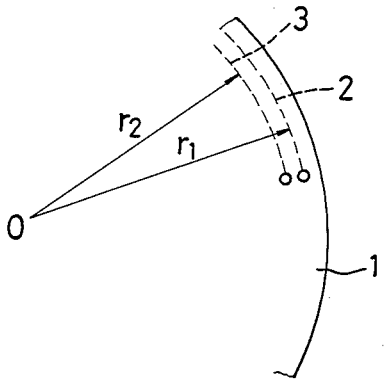
FIG. 5 PRIOR ART
FIG. 5 is a drawing illustrating the deficiencies of the conventional type of thread feeding device.

Referring to FIG. 3A, 3B, 3C which illustrate the principles of this invention and to the flow chart of FIG. 4, the operation of this invention will be explained. Referring to FIG. 3A, the first sensor 6, the second sensor 7, and the third sensor 8 are positioned with spacing $J_1$ $J_2$ as shown. The margin distance is m. The distance between two stitch lines which is the distance between two needles is G. The stitch pitch is set at P.

Referring to FIG. 3B, the radius of curvature of the workpiece 11 is detected by sensors 6, 7, 8, as $S_1$ $S_2$ $S_3$ respectively, and the data is stored to ROM 15 and RAM 6. The CPU 14 reads said $J_1$ $J_2$ m, G, for each needle 9, 10, respectively.

Referring to FIG. 3B and FIG. 3C, the CPU 14 operates $S_2$–$S_1$ and $S_3$–$S_2$ and, referring to $J_1$ $J_2$, two perpendicular bisectors will cross at point 0. Thus, the radius of curvature r is operated.

Referring to r, m and $K_1$ the stitch length $P_1$ of the stitch line 12 by the needle 9 is operated as follows:

$$P_1 = K_1 \times \left(\frac{1}{r - m}\right)$$

The stitch length $P_2$ of the stitch line 13 by the needle 10 is operated as follows:

$$P_2 = K_2 \times \left[\frac{1}{r - (G + m)}\right]$$

Referring to each stitch length $P_1$ $P_2$, the CPU 14 commands the pulse-motor drive 21 such that the first stepping motor 22 drives the first thread feeding apparatus 23 at the stitch length of $P_1$ and the second stepping motor 24 drives the second thread feeding apparatus 25 at the stitch length of $P_2$. The thread feeding method is conducted by rotating the stepping motor continuously while a restrictional device, which restricts the feeding of thread when feeding of one stitch pitch is finished, cooperates with the stepping motor.

Figure 7:
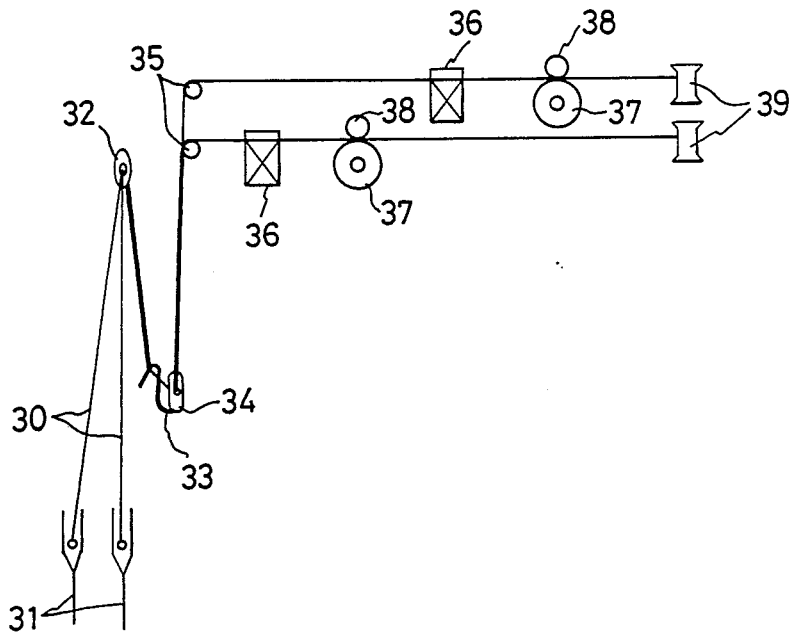
FIG. 7 is a schematic drawing for illustrating the thread feeding device according to one preferred embodiment of this invention.

Referring to FIG. 7, numeral 30 denotes each needle thread, numeral 31 denotes each needle, numeral 32 denotes a take-up lever, numeral 33 denotes a spring, numeral 36 denotes each thread restrictor, numeral 37 denotes each roller co-axial with each stepping motor shaft, numeral 34 denotes a thread guide, numeral 35 denotes each thread guide roller, numeral 38 denotes each presser roller pressing each needle thread against the roller 37, and numeral 39 denotes each spool.

Each roller 37 co-axial with the stepping motor shaft feeds required stitch length $P_1$ $P_2$ per one rotation of the main shaft, and each restrictor 36 acts to restrict feeding of needle thread by solenoid action just before the take-up lever starts pulling the thread to tighten the stitch. The timing for the start of the restriction will be conducted by an encoder (not shown) co-axial with the main shaft of sewing machine.

The number of restrictional devices may not be limited to one and multiple installation is contemplated. The motor for feeding the thread may also not be limited a to stepping motor but other types of motors which are designed to feed the required stitch length per each stitch are also applicable.

According to another embodiment, the stitch length $P_1$ of the stitch line 12 is adjusted longer than the stitch length $P_2$ of the stitch line 13. Thus, stitch lines 12, 13 are well stitched without causing any shrinking on the surface of workpiece.

In this embodiment, the first sensor 6, the second sensor 7, the third sensor 8 consist of photo-isolators but another type of line sensor consisting of one-lined CCD's (Charge Coupled Device) may be also applicable. An image sensor consisting of surfacially disposed integrated CCD (Charge Coupled Devices) may also be used to detect the end of workpiece, and from these detection, the radius of curvature will be derived. Solar cells may be used to detect the end of workpiece and an ultra sonic sensor will be used to detect the end of workpiece.

As to the above-described sensors, one image sensor will be enough in lieu of three sensors 6, 7, 8. The number of sensors are optional and more than four sensors to increase the accuracy is also contemplated.

Figure 6:
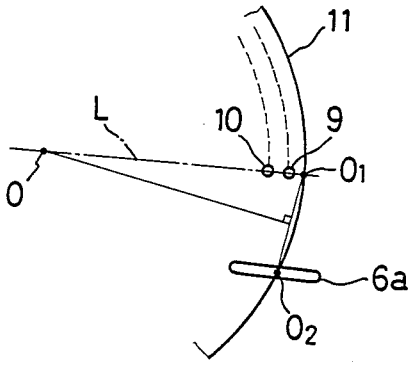
FIG. 6 is an illustrative drawing for another embodiment of this invention.

Referring to FIG. 6, where one sensor 6*a* is applied, the center 0 of the curvature of workpiece 11 is found by plotting a perpendicular bisector against line $0_1$ $0_2$ and then plotting a line L which connects the center of the two needles 9, 10, and finding the intersection of these two lines. The radius of curvature will be found as shown.

In this invention, the sensor is positioned in the counter-feed direction from the needle entry, but positioning in the feed direction from the needle entry is also contemplated because the radius of curvature is almost equal although the workpiece advanced beyond the needle entry so far as the sensor is positioned adjacent to needle entry. In this embodiment, two needles are located on one needle bar, but more than two needles may be installed on the needle bar.

As many apparently widely different embodiment of the invention may be made without departing the spirit and scope therein, it is to be understood that invention is not limited to the specific embodiment thereof except as defined in the appended claims.

What is claimed:

1. In a multiple needle sewing machine wherein multiple needles are installed at a needle bar, and a thread feeding apparatus is provided for each needle thread, said thread feeding apparatus feeds the thread individually such that curved and parallel stitch lines are stitched, sensors which detect a radius of curvature of a workpiece, a control means for operating said thread feeding apparatus so that each stitch length is based on said radius of curvature of the workpiece, and a thread feeder which feeds thread for each said stitch length.

2. A thread feeding apparatus according to claim 1 wherein said sensors are photo detectors comprising photo-transistors and photo-diodes.

3. A thread feeding apparatus according to claim 1 wherein said sensors are charge coupled devices.

4. A thread feeding apparatus according to claim 1 wherein said sensors are image sensors which comprise charge coupled devices.

5. A thread feeding apparatus according to claim 1 . wherein said sensors comprise solar cells.

6. A thread feeding apparat-us according to claim 1 wherein said sensors comprise ultrasonic sensors.

7. A thread feeding apparatus according to claim 1 wherein said thread feeder comprises stepping motors.

8. A thread feeding apparatus according to claim 1 in which said thread feed comprises motors which feed for each said stitch length.

* * * * *

UNITED STATES PATENT AND TRADEMARK OFFICE

CERTIFICATE OF CORRECTION

PATENT NO. : 4,843,986

DATED : July 4, 1989

INVENTOR(S) : Tadashi Kozuka, et al.

It is certified that error appears in the above-identified patent and that said Letters Patent is hereby corrected as shown below:

In Column 2, line 19, "a" should be --as--.

Signed and Sealed this

Fourteenth Day of August, 1990

*Attest:*

HARRY F. MANBECK, JR.

*Attesting Officer*

*Commissioner of Patents and Trademarks*